US005106315A

United States Patent [19]

Billman et al.

[11] Patent Number: 5,106,315

[45] Date of Patent: Apr. 21, 1992

[54] DUAL ROW SIMM SOCKET EJECTOR

[75] Inventors: Timothy B. Billman, King; Roger L. Thrush, Clemmons, both of N.C.

[73] Assignee: AMP Incorporated, Harrisburg, Pa.

[21] Appl. No.: 761,602

[22] Filed: Sep. 18, 1991

[51] Int. Cl.[5] ..... H01R 13/00

[52] U.S. Cl. ..... 439/160

[58] Field of Search ..... 439/152, 153, 155, 157-160

[56] References Cited

U.S. PATENT DOCUMENTS 2,817,825 12/1957 Zettle et al. ..... 439/160

4,698,024 10/1987 Maxwell ..... 439/62

4,898,540 2/1990 Saito ..... 439/153

4,973,255 11/1990 Rudoy ..... 439/160

4,990,097 2/1991 Billman et al. ..... 439/160

*Primary Examiner*—Joseph H. McGlynn

*Attorney, Agent, or Firm*—Allan B. Osborne

[57] ABSTRACT

An ejector (24) for use in a socket (10) having two parallel slots (12, 14) for receiving modules therein. The ejector (24) includes a cam (28) having lobes (38,40) at each end and a handle (26) for rotating the cam (28) and thereby lifting one or another lobe (38,40) to raise an end of a module out of one or another slot (12,14).

10 Claims, 3 Drawing Sheets

DUAL ROW SIMM SOCKET EJECTOR

FIELD OF THE INVENTION

The invention disclosed herein relates to dual row SIMM Sockets and devices for ejecting modules from the socket.

BACKGROUND OF THE INVENTION

It is well known to provide ejectors in single row SIMM sockets as U.S. Pat. Nos. 4,698,024 and 4,898,540 disclose. It is also known to provide an ejector for each row in a dual row SIMM socket as shown in U.S. Pat. No. 4,990,097. It is now proposed to provide a single ejector for a dual row SIMM socket.

SUMMARY OF THE INVENTION

According to the present invention an ejector is provided for a socket with two parallel, module-receiving slots. The ejector includes a cam having a lobe at each end and a handle for rotating the cam whereby one or the other lobe is raised to lift an edge of a module out of a slot.

DESCRIPTION OF THE INVENTION

Figure 1:
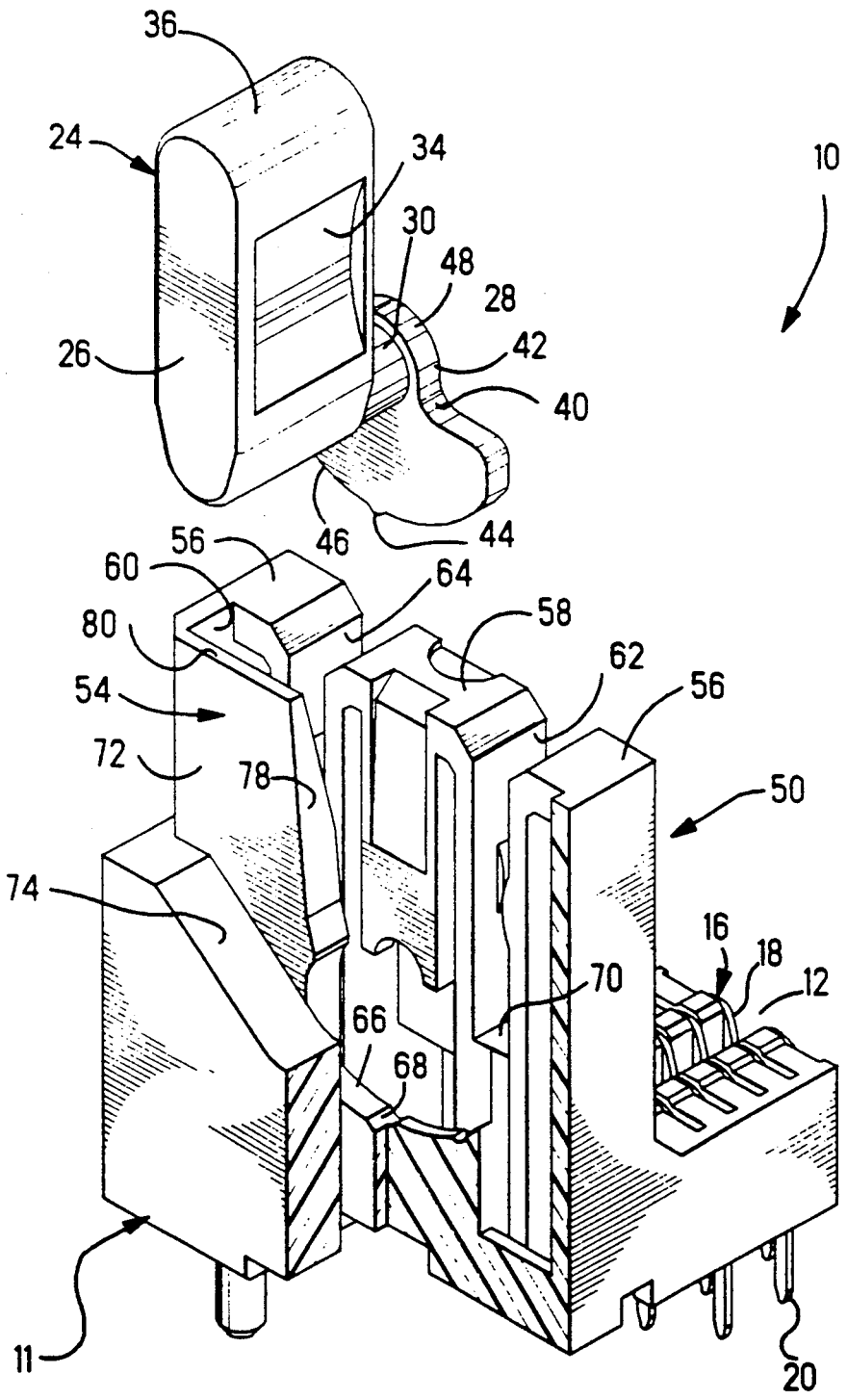
FIG. 1 is a partly sectioned view of a dual row SIMM socket with an ejector of the present invention exploded out.

SIMM (single in-line memory module) socket 10, shown in the several drawings, includes housing 11 having two side-by-side slots 12,14 (slot 14 not shown) which receive single in-line memory modules (not shown) so that the electronic components thereon can be electrically connected to circuits on an electronic substrate (not shown) on which socket 10 may be mounted. The interconnection is made through socket contact elements 16 having spring contact beams 18 on each side of respective slots 12,14 and leads 20 for insertion into the substrate.

Socket 10 further includes ejector 24 shown exploded out in FIG. 1. Ejector 24 includes handle 26, dual lobe cam 28 and shaft 30 between and connecting the handle and cam.

Handle 26 may be of any configuration and for use with fingers of a hand or a tool. As shown, indents 34 on each side provide positive and convenient locations for an operator's fore finger and thumb. A slot (not shown) in the top free end 36 of handle 26 would permit rotation of ejector 24 with a screw driver.

Cam 28 is somewhat kidney-shaped with convex shaped lobes 38,40 at each end of top edge 42 (only lobe 40 is shown). Further, outwardly projecting detent 44 is provided midway along the length of a gently rounded bottom edge 46.

Shaft 30 is cylindrical but could be of any convenient shape. As shown, shaft 30 connects cam 28 at its midpoint 48 between ends.

Socket 10 is based on a SIMM socket made and sold by AMP Incorporated under the name Dual Read-Out SIMM socket (see U.S. Pat. No. 4,990,097). End 50 has been modified for use with ejector 24.

End wall 54 is spaced from module support side posts 56 and center member 58 to define cam-receiving space or pocket 60. Gaps 62,64 between respective posts 56 and center member 58, are open to pocket 60 and slots 12,14.

Floor 66 of pocket 60 is spaced to conformably receive bottom edge 44 of cam 28 and includes recess 68 to receive detent 44 when ejector 24 is in a neutral position.

Floors 70 of gaps 62,64 are spaced above floor 66 so that lobes 38 on cam 28 are level with floors 70 when ejector 24 is positioned in socket 10.

Figure 5:
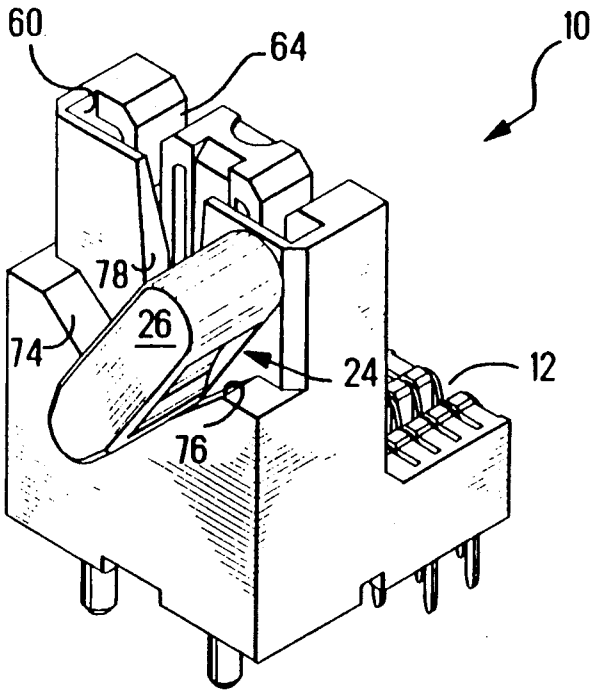
FIGS. 4 and 5 are views of the socket without the sectioning.
Figure 4:
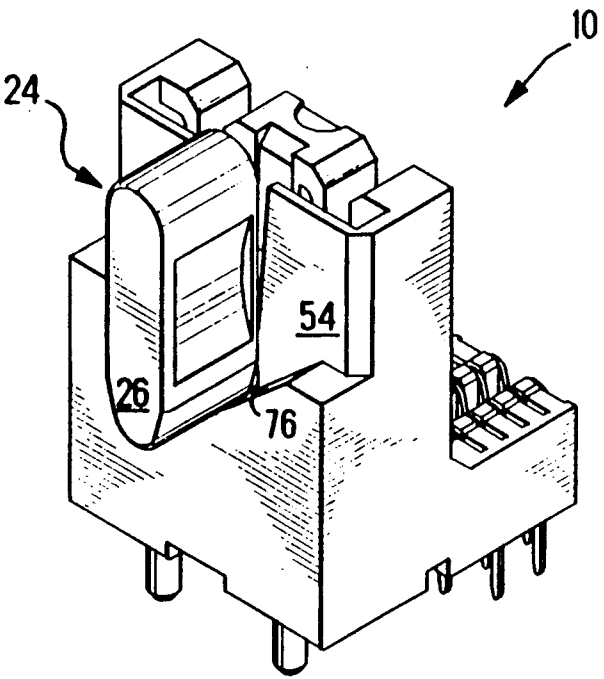

The outwardly facing surface 72 of end wall 54 is stepped and includes two sides 74,76 which are angled with respect to each other to form a V-shaped (side 76 is shown in FIGS. 4 and 5).

An opening 78 through end wall 54 extends from free edge 80 to adjacent floor 66 of pocket 60.

Ejector 24 is positioned in socket 10 by sliding cam 28 into pocket 60 to rest on floor 66. Shaft 30 extends through opening 78 and handle 26 is between sides 74,76 as shown in FIG. 2.

Figure 2:
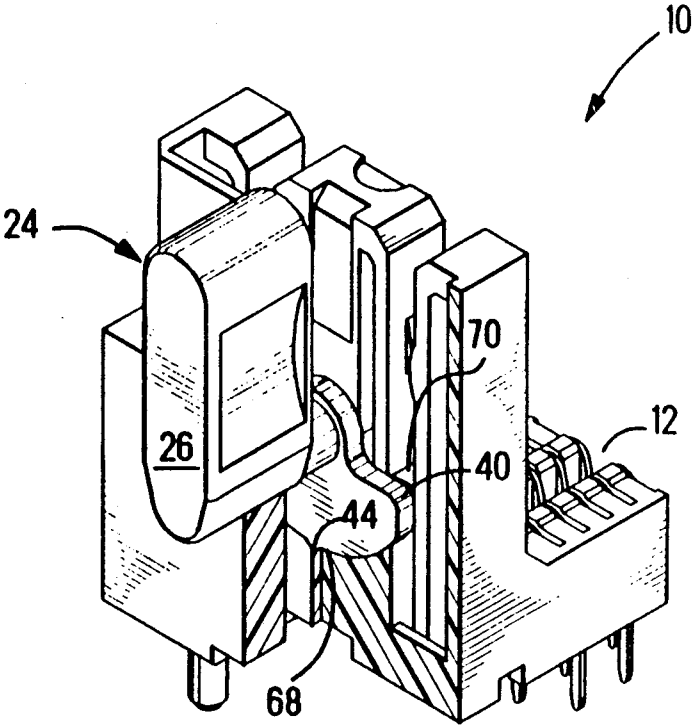

In FIGS. 2 and 4, ejector 24 is in a neutral position which is where both lobes 38,40 are on level with floors 70 in respective gaps 62,64 and detent 44 is in recess 68.

Figure 3:
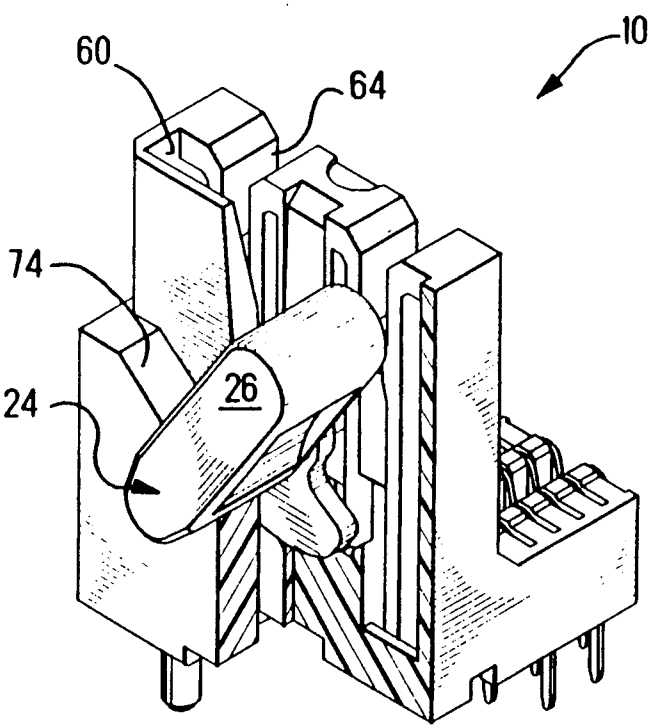
FIGS. 2 and 3 are partly sectioned views of the socket with the ejector in place.

To eject a module from slot 14 for example, handle 26 is rotated toward side 76 as shown in FIGS. 3 and 5. This causes cam 28 to rotate in the same direction whereby lobe 38 is raised, lifting an edge of a module extending into pocket 60 through gap 64. The operator can then grasp the raised end of the module and remove it from socket 10. A module in slot 12 is likewise removed by rotating handle 26 towards side 74.

Detent 44 and recess 68 cooperate to maintain handle 26 in an upright position and to require a deliberate force to actuate ejector 24.

The invention, ejector 24 and end 50 of socket 10, has been described in the context of a SIMM socket. However the invention can be used in any socket having slots for receiving electronic devices such as printed circuit cards as well as memory modules. Further, cam 28 and socket housing 11 can be modified such that lobes 38,40 are located in slots 12,14. Therefore the claims have been drafted to reflect the wider application of the invention.

As can be discerned from the foregoing discussion, a dual row SIMM socket having parallel module-receiving slots and a single ejector for serially lifting modules out of the socket has been disclosed. The ejector, located at one end of the socket, includes a cam having a lobe at each end and a handle for rotating the cam to raise one or the other lobe and thereby lift an end of a module out of the respective slot.

We claim:

1. An ejector for use in a socket having side-by-side slots for receiving electronic devices such as memory modules and circuit cards, said ejector comprising:

a cam-of a given length and having lifting lobe means spaced outwardly in opposite directions from a mid-point and further located on a common edge, said lobe means adapted to underlie a portion of electronic devices which may be positioned in the side-by-side slots; and actuating means connected to said midpoint on said cam to cause said cam to be rotated to raise a respective lobe means.

2. The ejector of claim 1 wherein said lobe means include surfaces of said common edge.

3. The ejector of claim 1 wherein said actuating means include a handle.

4. The ejector of claim 3 further including connecting means connecting said handle to said midpoint on said cam.

5. A socket for electronic devices such as memory modules and printed circuit substrates, said socket comprising:

a housing having adjacent slots for receiving electronic devices;

a cam having lifting lobe means spaced outwardly in opposite directions from a mid-point of said cam, said cam rotatably positioned in said housing with said lobe means adapted to underlie a portion of electronic devices which may be positioned in said adjacent slots; and actuating means for rotating said cam to raise a respective lobe means.

6. The socket of claim 5 wherein said actuating means include a handle.

7. The socket of claim 5 wherein said actuating means is engageable by a tool.

8. The socket of claim 5 wherein said cam is positioned at one end of said adjacent slots with said actuating means extending outwardly from said housing.

9. The socket of claim 8 wherein said cam is located in a pocket defined in part by a wall having gaps therethrough which are in registration with said slots.

10. The socket of claim 9 further including connecting means connecting said actuating means to said midpoint on said cam.

* * * * *